US011279591B2

(12) United States Patent
Hänninen et al.

(10) Patent No.: US 11,279,591 B2
(45) Date of Patent: Mar. 22, 2022

(54) ADJUSTABLE MULTICAR ELEVATOR SYSTEM

(71) Applicant: KONE Corporation, Helsinki (FI)

(72) Inventors: Ari Hänninen, Hyvinkää (FI); Ari Koivisto, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 959 days.

(21) Appl. No.: 16/002,431

(22) Filed: Jun. 7, 2018

(65) Prior Publication Data

US 2018/0282110 A1 Oct. 4, 2018

Related U.S. Application Data

(63) Continuation of application No. PCT/FI2015/050834, filed on Nov. 30, 2015.

(51) Int. Cl.
*B66B 1/24* (2006.01)
*B66B 1/34* (2006.01)
*B66B 9/00* (2006.01)

(52) U.S. Cl.
CPC ..... *B66B 1/2466* (2013.01); *B66B 1/2491* (2013.01); *B66B 1/3407* (2013.01);
(Continued)

(58) Field of Classification Search
CPC ... B66B 1/2466; B66B 1/2491; B66B 1/3407; B66B 9/003; B66B 2201/241; B66B 2201/242; B66B 2201/404
(Continued)

(56) References Cited

U.S. PATENT DOCUMENTS 5,503,249 A * 4/1996 Virtamo ..... B66B 1/2458 187/380
5,616,896 A * 4/1997 Kontturi ..... B66B 1/2458 187/382
(Continued)

FOREIGN PATENT DOCUMENTS

EP 2 003 081 A1 12/2008
JP 3035111 B2 2/2000
(Continued)

OTHER PUBLICATIONS

International Preliminary Report on Patentability for PCT/FI2015/050834 (PCT/IPEA/409) completed on Mar. 16, 2018.
(Continued)

*Primary Examiner* — Jeffrey Donels
(74) *Attorney, Agent, or Firm* — Birch, Stewart, Kolasch & Birch, LLP

(57) ABSTRACT

A multicar elevator system includes a group of individually drivable elevator cars and two shafts coupled to each other with at least two transfer channels. The system further includes a control unit configured to operate the system in either of two operating modes, wherein in the first mode the group of elevator cars is arranged to travel to a first vertical direction in the first shaft and to another vertical direction in the second shaft through the transfer channels. In the second mode, a first sub-group of elevator cars are parked in one of the shafts and at least one elevator car belonging to a second sub-group of elevator cars is arranged to travel in the both vertical directions in the other shaft upon a call.

14 Claims, 4 Drawing Sheets

(52) U.S. Cl.
CPC ..... *B66B 9/003* (2013.01); *B66B 2201/241* (2013.01); *B66B 2201/242* (2013.01); *B66B 2201/404* (2013.01)

(58) Field of Classification Search
USPC ..... 187/247
See application file for complete search history.

(56) References Cited

U.S. PATENT DOCUMENTS

| | | | | |
|---|---|---|---|---|
| 2003/0217893 | A1 | 11/2003 | Dunser et al. | |
| 2007/0089935 | A1 | 4/2007 | Hikita | |
| 2011/0042168 | A1 | 2/2011 | Grundmann | |
| 2014/0190774 | A1 | 7/2014 | Hsu | |
| 2016/0297646 | A1* | 10/2016 | Piech | B66B 7/021 |
| 2016/0304317 | A1* | 10/2016 | Witczak | B66B 11/04 |
| 2018/0273342 | A1* | 9/2018 | Hanninen | B66B 1/2466 |

FOREIGN PATENT DOCUMENTS

| | | | |
|---|---|---|---|
| JP | 3448890 | B2 | 7/2003 |
| JP | 2013-095546 | A | 5/2013 |
| JP | 2013-103816 | A | 5/2013 |
| KR | 10-2015-0133666 | A | 11/2015 |
| WO | WO 2015/084368 | A1 | 6/2015 |
| WO | WO 2015/084371 | A1 | 6/2015 |
| WO | WO 2015/178682 | A1 | 11/2015 |

OTHER PUBLICATIONS

International Search Report for PCT/FI2015/050834 (PCT/ISA/210) dated Feb. 15, 2016.
Written Opinion of the International Searching Authority for PCT/FI2015/050834 (PCT/ISA/237) dated Feb. 15, 2016.

* cited by examiner

ADJUSTABLE MULTICAR ELEVATOR SYSTEM

CROSS REFERENCE TO RELATED APPLICATIONS

This application is a Continuation of PCT International Application No. PCT/FI2015/050834, filed on Nov. 30, 2015, which is hereby expressly incorporated by reference into the present application.

TECHNICAL FIELD

The invention relates generally to a technical field of elevator solutions. More particularly, the invention relates to multicar elevator system.

BACKGROUND

So called multicar solutions have been under interest in elevator solutions for a long time. The multicar solution refers to an implementation wherein multiple elevator cars are arranged to travel, at least temporarily, in the same pathway, such as in the same shaft. FIG. 1 illustrates an example of a prior art solution in which elevator cars 110A-110D are configured to travel in two pathways in a building 100. The elevator cars 110A-110D are arranged to travel upwards in the right pathway and downwards in the left pathway. The elevator cars 110A-110D may transfer the pathway on a top and on a bottom of the building i.e. there are transfer channels between the pathways, which are equipped with necessary transfer devices.

The multicar solution in which all the elevator cars travel in the same direction may be implemented so that the motion of all elevator cars is synchronous (pater noster type) or so that each elevator car moves independently within its location in the elevator car queue. As one can directly understand from the above the described multicar solution is not very dynamic in a sense that each car is blocked between other two elevator cars. This means that even if an elevator car 110A-110D is able to move independently two other elevator cars at least limit the individual motion so that the independent motion is only theoretically possible. This means vice versa that if a passenger enters one elevator car 110A-110D all other elevator cars shall also be driven along the pathways so that the passenger may be served without unduly delay. The multicar solution as described may also require so called parking space 120 that is used e.g. for storage and maintenance purposes.

The drawbacks of the described solution are quite straightforward. The undynamic operation is one big problem in applying the described multicar arrangement in practice. The undynamic operation brings additional costs as the elevator system shall be implemented so that if one elevator car 110A-110D serves a passenger all the elevator cars shall also be moved. Operating such a system is costly, due the costs arising from energy consumption among others, and requires extra maintenance work as well as space for parking the elevator cars.

Hence, there is need to mitigate the described drawbacks by developing further the elevator system, and its elements, as described.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

In accordance with the invention, there is provided a multicar elevator system and a method for controlling a multicar elevator system. The multicar elevator system according to the invention comprises:

- a group of individually drivable elevator cars,
- two shafts coupled to each other with at least two transfer channels, wherein the elevator system further comprising a control unit, which is configured to control the elevator system to operate in either of two operating modes wherein

- in the first operating mode the group of elevator cars is arranged to travel to a first vertical direction in the first shaft and to another vertical direction in the second shaft and wherein each of the elevator cars is transferred be-tween the shafts through the at least two transfer channels wherein the travel of the group of elevator cars is initiated upon a call, and
- in the second operating mode a first sub-group of elevator cars is arranged to be parked in one of the shafts and at least one elevator car belonging to a second sub-group of elevator cars is allowed to travel in any vertical direction in the other shaft upon a call.

The control unit may further be configured to control the operation of the elevator system, in the second operating mode, by instructing an adjustment of a number of elevator cars in the second sub-group.

Moreover, the control unit may be configured to control the operation of the elevator system on a basis of a result of a cost function representing an operational state of the elevator system.

The adjustment may be based on a comparison of the result of the cost function to at least one threshold value obtainable by the control unit.

Alternatively or in addition, the control unit may further be configured to, in the second operating mode, to control the elevator system by instructing at least one of the elevator cars belonging to the second sub-group to transfer through one of the transfer channels to the one shaft if the at least one elevator car prevents an accomplishment of the call given to one other elevator car belonging to the second sub-group. The control unit may be configured to, in response to instructing the at least one of the elevator cars belonging to the second sub-group to transfer to the other shaft through the one of the transfer channels, to further control the elevator system by instructing at least one further elevator car being parked in the one shaft to transfer to the other shaft through the other transfer channel.

Further, the control unit may be configured to control the operation of the elevator system in the second mode so that at least one elevator car belonging to the second sub-group is instructed to serve a first portion of the other shaft and at least one other elevator car is instructed to serve a second portion of the other shaft wherein the first portion of the shaft and the second portion of the shaft overlap so that the elevator cars serve at least one common floor.

The method for controlling an operation of a multicar elevator system according to the invention comprises:

- determining an operational state of the elevator system, and controlling the operation of the elevator system by selecting an operating mode for the elevator system on the basis of the determined operational state of the elevator system, wherein the operating mode is selected between two operating modes wherein in the first operating mode the group of elevator cars is arranged to travel to a first vertical direction in the first shaft and to another vertical direction in the second shaft and wherein each of the elevator cars is transferred between the shafts through the at least two transfer channels wherein the travel of the group of elevator cars is initiated upon a call, and in the second operating mode a first sub-group of elevator cars is arranged to be parked in one of the shafts and at least one elevator car belonging to a second sub-group of elevator cars is allowed to travel in any vertical direction in the other shaft upon a call.

The method may further comprise:

controlling the operation of the elevator system, in the second operating mode, by instructing an adjustment of a number of elevator cars in the second sub-group.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF THE FIGURES

Exemplifying and non-limiting embodiments of the invention and their advantages are explained in greater detail below in the sense of examples and with reference to the accompanying drawings, in which.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

Figure 1:
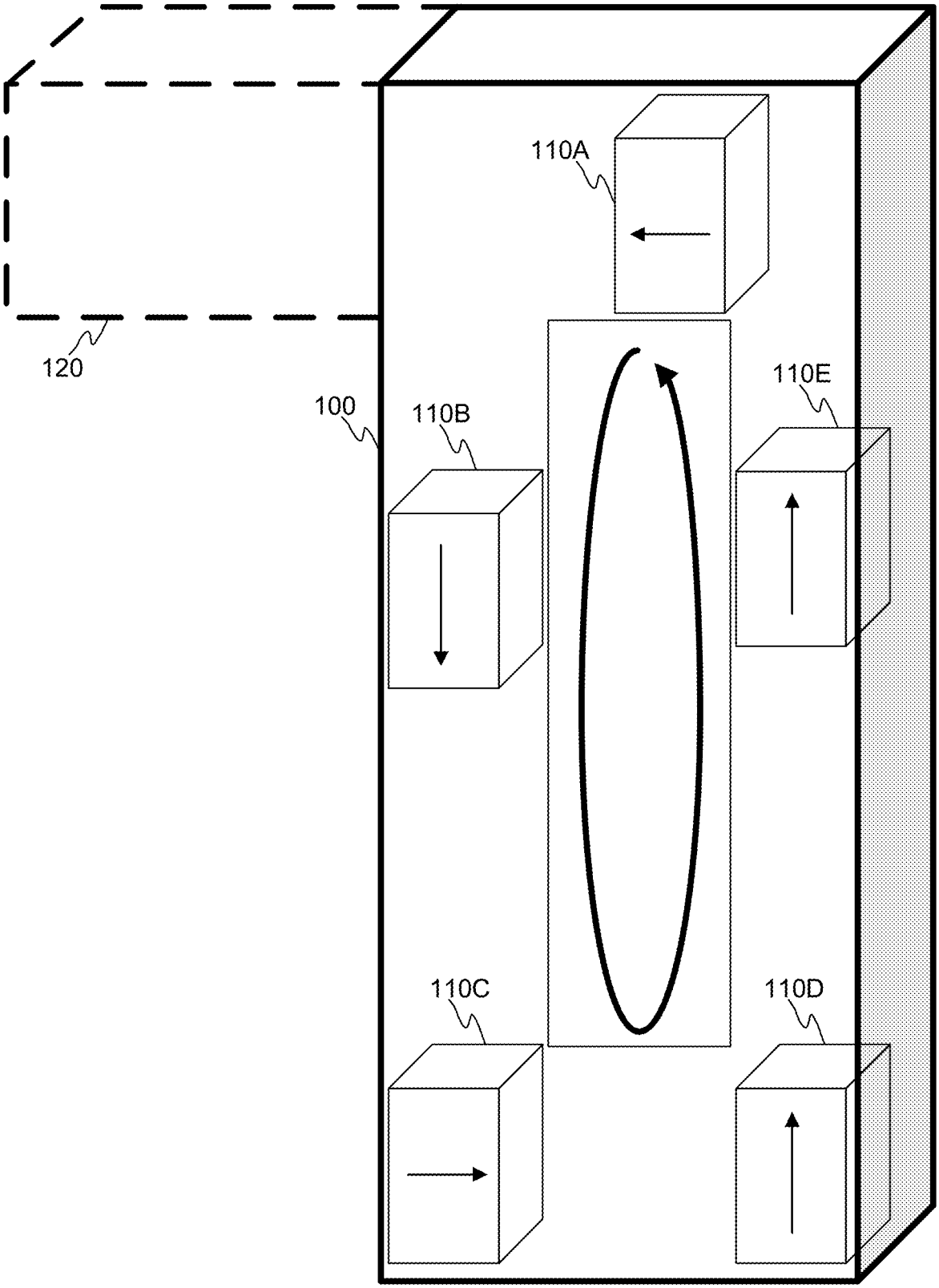
FIGURE 1 PRIOR ART
FIG. 1 shows a schematic illustration of an elevator solution according to prior art.
Figure 2:
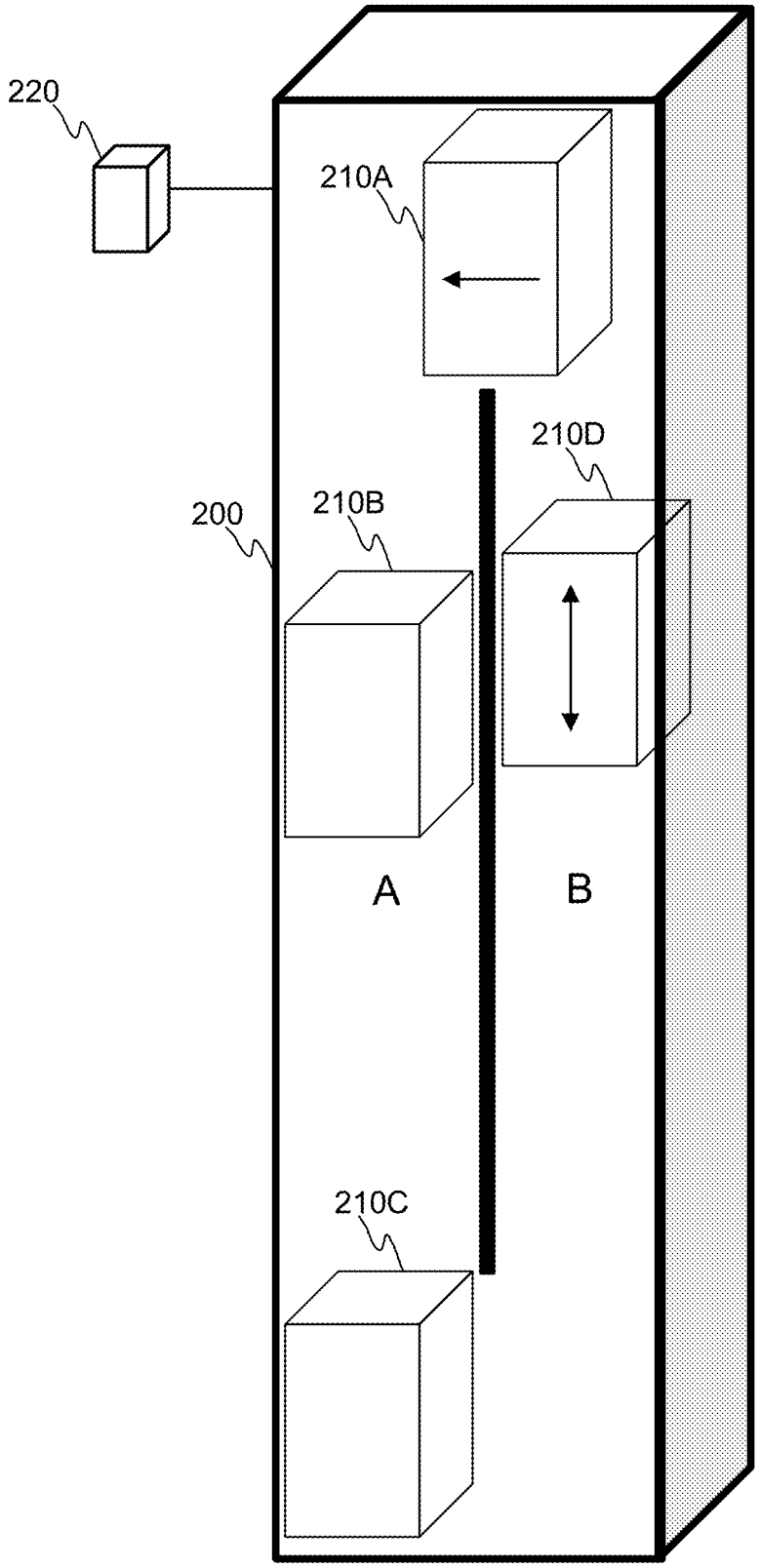
FIG. 2 shows a schematic illustration of an elevator system according to an embodiment of the invention.

FIG. 2 schematically illustrates an elevator system according to an embodiment of the present invention. The elevator system is implemented in a building 200 and it consist of two shafts A, B, which are typically two vertical pathways next to each other. They may be separated from each other with a wall or with a necessary space between the pathways. In case the shafts are separated with a wall there are arranged one or more transfer channels which couple the shafts so that the elevator cars 210A-210D, or at least some of them, may be transferred between the shafts A, B. In case there is no any wall, but an open space the transfer channels may be implemented with transfer means, such as with applicable rails, in the open space.

The elevator system according to the embodiment of the invention is implemented so that it comprises a group of individually drivable elevator cars 210A-210D, wherein the group comprises at least two individually drivable elevator cars 210A-210D. As said the two shafts may be coupled to each other with at least two transfer channels. The elevator system according to an embodiment of the invention comprises a control unit 220 that is configured to control an operation of the elevator system. Especially, the control unit 220 may be configured to operate the elevator system in one operating mode of two operating modes wherein in the first operating mode the elevator cars is arranged to travel to a first vertical direction in the first shaft and to another vertical direction in the second shaft and wherein the elevator cars are transferred between the shafts through the at least two transfer channels. In other words, the elevator cars travel a circular loop in the shafts A, B through the transfer channels. The travel of the group of elevator cars is initiated upon a call, i.e. an indication of a need to use the elevator system is given. The indication may e.g. be given by a passenger in a floor he/she is residing which causes the elevator system to operate so that an elevator car 210A-210D is instructed to travel to the floor in order to pick up the passenger. This may cause also other elevator cars, or at least one other, to move along the circular loop, especially in a situation wherein the passengers requests a trip which is in conflict with at least one other elevator car i.e. the at least one other elevator car blocks the completion of the requested trip at the time of the request.

The control unit 220 of elevator system according to the present embodiment may cause the elevator system to operate in a second operating mode in which a first sub-group of elevator cars may be arranged to be parked in one of the shafts A or B and at least one elevator car belonging to a second sub-group of elevator cars may travel in any vertical direction in the other shaft. Again, the travel may be initiated upon a call, or request, of at least one of the elevator cars belonging to the second sub-group of elevator cars. The call may also determine the direction to which the elevator car in question shall travel in the shaft. The elevator system may e.g. be arranged to operate in the second operating mode on a basis of a predetermined criterion or criteria.

For example, the elevator system according to an embodiment of the present invention as schematically illustrated in FIG. 2 may be arranged to operate so that all other elevator cars 210A, 210B, 210C but one 210D are arranged to be parked in the shaft A. For example, the elevator car 210A is transferred from the shaft B to shaft A for parking in the situation of FIG. 2. The elevator car 210D in the shaft B may now be operated so that it may travel in both vertical directions (i.e. upwards and downwards) in the shaft B, when the elevator system is operated in the second operating mode by the control unit 220.

Moreover, the control unit may further be configured to control the operation of the elevator system in the second operating mode so that it may adjust a number of elevator cars in the second sub-group by providing a control signal, i.e. instruction, to one or more elevator cars. In other words, the number of elevator cars may be added or reduced according to a need as determined.

Some aspects of the present invention relates to determination of a need to control the operation of the elevator system wherein the controlling may comprise a selection of the operating mode of the elevator system. The determination of the operating mode, and the selection of it in response to the determination, may be arranged so that a cost function taking into account one or more predetermined service parameters may be established and on a basis of the outcome of the cost function the operating mode of the elevator system may be selected. The determination of the cost function may generate a value representing an operational state of the elevator system. Based on the value of the cost function it is possible to select an optimal operating mode of the elevator system and/or to adjust the number of elevator cars in the first and the second sub-groups when the elevator system is operating in the second mode.

In order to determine the value of the cost function applicable parameters shall be used in the calculation of the cost function. In the following some non-limiting examples of the parameters and/or sources of information for the cost function are introduced:

History data on the operation, such as a utilization rate, of the elevator system is collected e.g. on a time (and date) basis. The history data may comprise only information on the elevator system in question or comprise information on a plurality of elevator systems collected in a database. The control unit 220 of the elevator system in question may retrieve the information and at least partly on the basis of the information to control the operation of the elevator system. Alternatively or in addition, the control unit 220 may directly receive instructions from a central unit controlling one or more elevator systems.

The control unit 220 of the elevator system in question is configured to monitor the service level of received calls e.g. over a predetermined time window, such as five minutes, and based on that information to adjust the operating mode of the elevator system if necessary by inputting the obtained information into the cost function. The determination of the service level may take into account the waiting time between the received call to the arrival of an elevator car and/or total time from the call to an arrival in the target floor, for instance.

A number of calls, especially active calls at a moment or over a time window. The number of calls may also be represented as some statistical value, such as an average, over a period of time.

An elevator car weight related aspects, such as an average load of the elevator car over a period of time when the elevator car is fulfilling calls. The weight provides indication on the utilization rate of the elevator system at least to some extent. The weighting of the elevator cars may be performed with known methods.

According to an embodiment of the invention one or more threshold values may be defined to which the result of the cost function may be compared. A first threshold value may define a point at which the elevator system when operating in the second operating mode does not provide a desired service level. Thus, the operation of the elevator system shall be adjusted. The adjustment may e.g. be arranged so that primarily the elevator system is intended to be kept in the second operating mode and at least one elevator car shall be taken into use in the second operating mode. Secondarily, the elevator system may be controlled to change from the second operating mode to the first operating mode. The selection between the primary and secondary options may e.g. be made on the basis of a deviation of the value of the cost function with respect to the first threshold value. For example, if the deviation is less than a certain percentage, such as 20%, from the first threshold, the elevator system is maintained in the second operating mode, but one more elevator cars is added in operation. On the other hand, if the deviation is more than the certain percentage, the elevator system may be taken to the first operating mode.

In addition to the first threshold value a second threshold value may be used in the elevator system for selecting an optimal operating state of the system. The second threshold value may define a point at which the elevator system uses too much its capacity to fulfill the required service level in the first operating mode. For example, if the value i.e. the result of the cost function is below the threshold, in that case the elevator system may be controlled to change from the first mode to the second mode, and possibly the number of elevator cars may also be defined. As a result the capacity used may be adjusted to the need.

Herein is mainly referred to an implementation in which the cost function is independent on the mode in which the elevator system is operating. In some further embodiment the invention may be implemented so that there are established separate cost functions for the different operating modes of the elevator system. The advantage of such an implementation of the invention is that it is possible to emphasize different parameters for the different operating modes. The one or more thresholds may also be chosen differently for the different cost functions. Such an embodiment enables a more sophisticated way to control a selection between the operating modes.

A practical non-limiting example of the use of thresholds within the inventive idea of the present invention may be the following. The elevator system is in the first operating mode and an average number of passengers in the elevator cars is monitored e.g. during a predefined period of time, like 5 minutes. If the result is below a first threshold, the elevator system is controlled to change its operating mode to the second operating mode. For example, three elevator cars may be taken into use in the second shaft and other elevator cars are parked. In the second operating mode it is measured another parameter, like average waiting time. If it is below a second threshold, one elevator car may be parked in the first shaft. On the other hand, if the waiting time exceeds a third threshold, at least one elevator car may be taken into the second shaft for serving the passengers and, thus, to improve service quality. There may also be determined maximum number of elevator cars that may be taken into use in the second shaft in the second operating mode. If this maximum number of elevator cars is already in use and the determination indicates that one more elevator car is needed, the elevator system may be taken back to the first operating mode. As can be seen from this non-limiting example, it is possible to determine multiple thresholds and different cost functions, or at least the parameters taken into account, in order to provide sophisticated elevator systems with the present invention.

During the operation of the elevator system when the operating mode is the second, i.e. a first sub-group of elevator cars is arranged to be parked in one of the shafts and at least one elevator car belonging to a second sub-group of elevator cars is allowed to travel in any vertical direction in the other shaft upon a call, it may turn out that one elevator car is in such a position in the shaft that it prevents an accomplishment of a call given to the at least one elevator car. As an example, it may happen that there are two elevator cars driven under the second operating mode. The lower car of the two elevator cars receives a call to travel to the topmost floor, but the other car resides between the lower car and the topmost floor. In such a case the control unit 220 may be configured to instruct the blocking elevator car to transfer through one of the transfer channels to the other shaft at least temporarily. The transferred elevator car may return to the shaft in which the elevator cars may travel in the second operating mode after the at least one other car has traveled to such a location in the shaft that the transferred elevator car does not prevent the accomplishment of the call anymore.

Alternatively or in addition to the above, the present invention may be implemented in one embodiment so that if one elevator car prevents accomplishment of a call of another elevator car and is transferred to the other shaft through one of the transfer channels, e.g. the topmost for example, another elevator car being parked may be brought in the shaft in which the elevator cars travel, through another transfer channel, e.g. the bottommost for example. In other words, one or more elevator cars change their sub-groups into which they belong to. This kind of control of the elevator cars enhances a dynamic operation of the elevator system and may improve efficiency of the system.

One or more elevator cars residing in the shaft in which the elevator cars are parked may be re-positioned in the shaft if the control unit has instructed, i.e. generated and transmitted a motion signal, one or more elevator cars in the other shaft to transfer to the shaft reserved for parking. The re-positioning may be initiated e.g. in such a situation that one elevator car residing in the parking shaft blocks an entrance of another elevator car from the other shaft to the parking shaft. Naturally, this kind of re-positioning may cause so called chain reaction and a plurality of elevator cars shall be re-positioned.

According to still further embodiment of the present invention the elevator system may be arranged to operate so in the second operating mode that an elevator car belonging to the second sub-group is arranged and instructed to serve a first portion of the other shaft, i.e. a first number of floors, and at least one other elevator car is instructed to serve a second portion of the other shaft, i.e. a second number of floors, wherein the first portion of the shaft and the second portion of the shaft overlap so that the elevator cars serve at least one common floor. In other words, the multicar elevator system according to the present invention may be controlled to operate in such a mode the different elevator cars are configured to serve own zones consisting of plurality of floors that may overlap.

Figure 3:
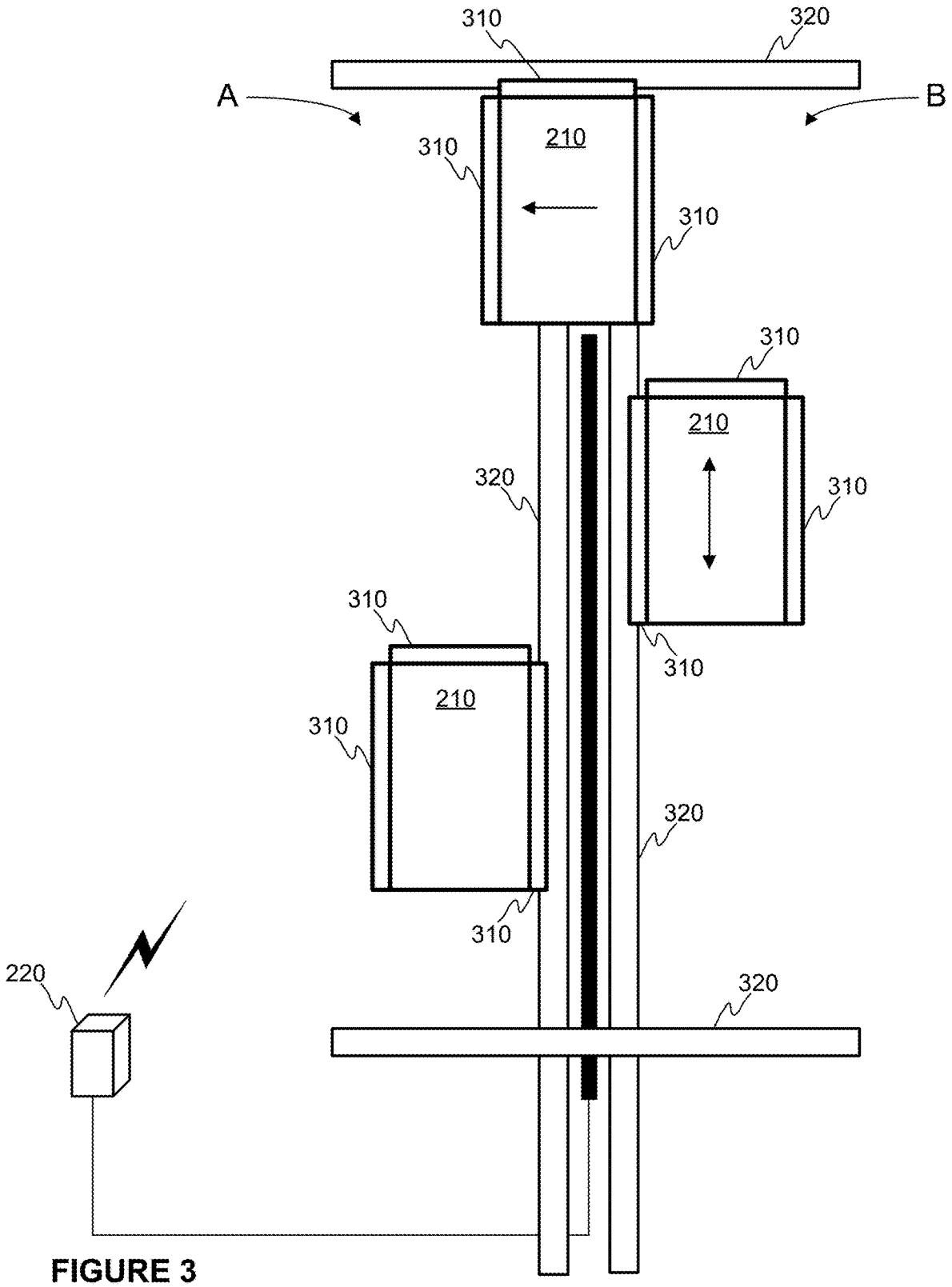
FIG. 3 shows another schematic illustration of an elevator system according to an embodiment of the invention.

Next, an example of the elevator system according to the invention is described by referring to FIG. 3 that schematically illustrates a possible implementation of the present invention. The elevator system may be based on a utilization of linear motors wherein the motor part resides in the elevator cars 210 and the stator part is arranged to follow a rail along which the elevator cars 210 are arranged to travel. In an implementation as depicted in FIG. 3 the elevator cars 210 are equipped with motor parts 310 that are arranged on outer walls of the elevator cars 210 and on the roof of the elevator cars 210. The stator parts, as said above, may be arranged in or on the rails 320 that are mounted on the shaft so that the travel of the elevator cars 210 may be arranged along them. In other words, the motor parts 310 comprise such element, such as gearwheel, that cooperates with the rail 320 so that the elevator cars 210 may be moved in the elevator system. As may be seen from FIG. 3 the elevator system may comprise multiple separate rail sections that are used in moving the elevator cars 210 to different directions. The vertical rail sections in FIG. 3 are meant to be used for vertical motion and the horizontal rail sections for horizontal motion i.e. transferring the elevator cars between the shafts A, B. The elevator cars may also comprise gripping devices by means of which an elevator car may be arranged to grip to the rails so that the motor part may provide the force to move the elevator car along the rail. Further, the gripping means increases the safety as an individual elevator car is always safely fixed to at least one rail 320. Furthermore, the elevator system comprises necessary power wiring in order to bring electricity to the elevator cars and to the system as a whole. Moreover, the elevator system comprises a control unit 220 configured to generate control signals, i.e. instructions, to the system and elevator cars 210. The communication between the entities may be arranged either in a wired manner or wirelessly, or both. The elevator cars 210 may also comprise local control units that may be configured to control the operation of the elevator cars locally operating as slaves to the master control unit 220, for instance.

Figure 4:
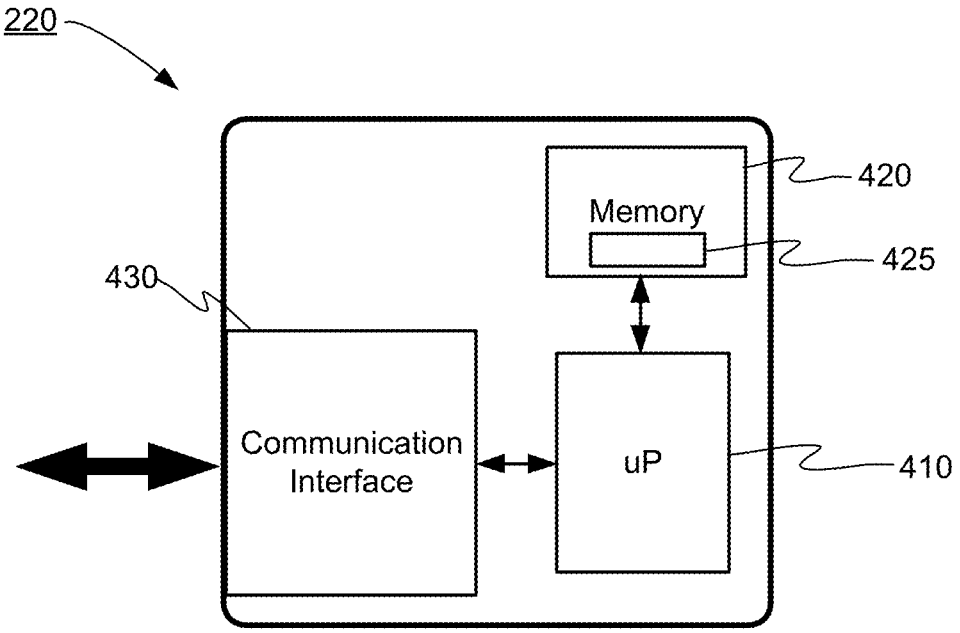
FIG. 4 shows a schematic illustration of a control unit according to an embodiment of the invention.

FIG. 4 illustrates schematically an example of the control unit 220 according to the invention. The control unit 220 may comprise one or more microprocessors 410, one or more memories 420 storing portions of computer program code and necessary data values 425, such as threshold values, for enabling an implementation of the invention. In other words, the microprocessor 410 may be configured to, by executing at least portions of the computer program code, to cause the control unit 220 to operate as explained. Moreover, the control unit 220 comprises a communication interface 430 that comprises necessary modems and any other communication hardware by means of which the control unit 220 may communicate with the entities, such as elevator cars, belonging to the elevator system and/or any external entities that may provide necessary information for the control unit 220. The communication is advantageously controlled by the microprocessor 410.

Figure 5:
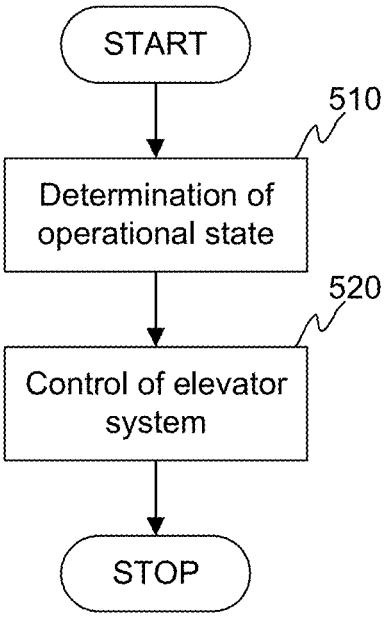
FIG. 5 shows a schematic illustration of a method according to an embodiment of the invention.

FIG. 5 illustrates a method according to an embodiment of the present invention. In the method a value of an operational state of a multicar elevator system is determined 510. The determination may be performed, by the control unit, by calculating a cost function that takes into account one or more service parameters representing operational aspects, among any other, of the elevator system. The operational aspects may e.g. be time dependent at least in some embodiments of the invention. Further, on a basis of the outcome of the cost function, the operating mode of the elevator system may be controlled 520 wherein the controlling may comprise either a selection of the operating mode between a first operating mode and a second operating mode (e.g. if the elevator system is initiated in operation) or a change of the operating mode between the first and the second operating modes. Furthermore, the selection may comprise an internal modification of the operation of the elevator system in the second operating mode which refers to a situation in which one or more elevator cars are either removed from or added in the second sub-group.

The invention as described herein reduces costs especially because it is possible to drive the elevator system into such mode that it is adjustable to the needed elevator resources in order to serve passengers. The cost savings arise from reduced energy costs among others. Moreover, the multicar elevator system implemented in the described way reduces needed space for the elevator system as there is no need to arrange parking space for one or more elevator cars, because the elevator system may be driven into such a mode that the other shaft may operate as a parking space.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A multicar elevator system comprising:

a group of individually drivable elevator cars; two shafts coupled to each other with at least two transfer channels; and a control unit configured to control the elevator system to operate in either of two operating modes, wherein:

in the first operating mode the group of elevator cars is arranged to travel to a first vertical direction in the first shaft and to another vertical direction in the second shaft and wherein each of the elevator cars is transferred between the shafts through the at least two transfer channels wherein the travel of the group of elevator cars is initiated upon a call, in the second operating mode a first sub-group of elevator cars is arranged to be parked in one of the shafts and at least one elevator car belonging to a second sub-group of elevator cars is allowed to travel in any vertical direction in the other shaft upon a call, and the control unit is further configured to control the operation of the elevator system, in the second operating mode, by instructing an adjustment of a number of elevator cars in the second sub-group.

2. The multicar elevator system of claim 1, wherein the control unit is configured to control the operation of the elevator system on a basis of a result of a cost function representing an operational state of the elevator system.

3. The multicar elevator system according to claim 1, wherein the adjustment is based on a comparison of the result of the cost function to at least one threshold value obtainable by the control unit.

4. The multicar elevator system according to claim 1, wherein the control unit is further configured to, in the second operating mode, to control the elevator system by instructing at least one of the elevator cars belonging to the second sub-group to transfer through one of the transfer channels to the one shaft if the at least one elevator car prevents an accomplishment of the call given to one other elevator car belonging to the second sub-group.

5. The multicar elevator system according to the claim 4, wherein the control unit is configured to, in response to instructing the at least one of the elevator cars belonging to the second sub-group to transfer to the other shaft through the one of the transfer channels, to further control the elevator system by instructing at least one further elevator car being parked in the one shaft to transfer to the other shaft through the other transfer channel.

6. The multicar elevator system according to claim 1, wherein the control unit is further configured to control the operation of the elevator system in the second mode so that at least one elevator car belonging to the second sub-group is instructed to serve a first portion of the other shaft and at least one other elevator car is instructed to serve a second portion of the other shaft wherein the first portion of the shaft and the second portion of the shaft overlap so that the elevator cars serve at least one common floor.

7. The multicar elevator system according to claim 2, wherein the adjustment is based on a comparison of the result of the cost function to at least one threshold value obtainable by the control unit.

8. The multicar elevator system according to claim 2, wherein the control unit is further configured to, in the second operating mode, to control the elevator system by instructing at least one of the elevator cars belonging to the second sub-group to transfer through one of the transfer channels to the one shaft if the at least one elevator car prevents an accomplishment of the call given to one other elevator car belonging to the second sub-group.

9. The multicar elevator system according to claim 3, wherein the control unit is further configured to, in the second operating mode, to control the elevator system by instructing at least one of the elevator cars belonging to the second sub-group to transfer through one of the transfer channels to the one shaft if the at least one elevator car prevents an accomplishment of the call given to one other elevator car belonging to the second sub-group.

10. The multicar elevator system according to claim 2, wherein the control unit is further configured to control the operation of the elevator system in the second mode so that at least one elevator car belonging to the second sub-group is instructed to serve a first portion of the other shaft and at least one other elevator car is instructed to serve a second portion of the other shaft wherein the first portion of the shaft and the second portion of the shaft overlap so that the elevator cars serve at least one common floor.

11. The multicar elevator system according to claim 3, wherein the control unit is further configured to control the operation of the elevator system in the second mode so that at least one elevator car belonging to the second sub-group is instructed to serve a first portion of the other shaft and at least one other elevator car is instructed to serve a second portion of the other shaft wherein the first portion of the shaft and the second portion of the shaft overlap so that the elevator cars serve at least one common floor.

12. The multicar elevator system according to claim 4, wherein the control unit is further configured to control the operation of the elevator system in the second mode so that at least one elevator car belonging to the second sub-group is instructed to serve a first portion of the other shaft and at least one other elevator car is instructed to serve a second portion of the other shaft wherein the first portion of the shaft and the second portion of the shaft overlap so that the elevator cars serve at least one common floor.

13. The multicar elevator system according to claim 5, wherein the control unit is further configured to control the operation of the elevator system in the second mode so that at least one elevator car belonging to the second sub-group is instructed to serve a first portion of the other shaft and at least one other elevator car is instructed to serve a second portion of the other shaft wherein the first portion of the shaft and the second portion of the shaft overlap so that the elevator cars serve at least one common floor.

14. A method for controlling an operation of a multicar elevator system, the method comprising:

determining an operational state of the elevator system; and controlling the operation of the elevator system by selecting an operating mode for the elevator system on the basis of the determined operational state of the elevator system, wherein the operating mode is selected between two operating modes, wherein:

in the first operating mode the group of elevator cars is arranged to travel to a first vertical direction in the first shaft and to another vertical direction in the second shaft and wherein each of the elevator cars is transferred between the shafts through the at least two transfer channels wherein the travel of the group of elevator cars is initiated upon a call, in the second operating mode a first sub-group of elevator cars is arranged to be parked in one of the shafts and at least one elevator car belonging to a second sub-group of elevator cars is allowed to travel in any vertical direction in the other shaft upon a call, and in the second operating mode, controlling the operation of the elevator system, by instructing an adjustment of a number of elevator cars in the second sub-group.

* * * * *